US009651058B1

(12) United States Patent
Mares et al.

(10) Patent No.: US 9,651,058 B1
(45) Date of Patent: May 16, 2017

(54) T-SHAPED FAN BLADE ARM ATTACHMENT

(71) Applicant: LITEX INDUSTRIES, LIMITED, Grand Prairie, TX (US)

(72) Inventors: John F. Mares, Grand Prairie, TX (US); Donald J. Ladanyi, Westlake, OH (US); Zhi Jian He, Zhongshan (CN); Shou Zhi Li, Zhongshan (CN)

(73) Assignee: LITEX INDUSTRIES, LIMITED, Grand Prairie, TX (US)

( * ) Notice: Subject to any disclaimer, the term of this patent is extended or adjusted under 35 U.S.C. 154(b) by 352 days.

(21) Appl. No.: 14/325,322

(22) Filed: Jul. 7, 2014

Related U.S. Application Data

(60) Provisional application No. 61/843,079, filed on Jul. 5, 2013.

(51) Int. Cl.
*F04D 29/34* (2006.01)
*F04D 25/08* (2006.01)

(52) U.S. Cl.
CPC ..... *F04D 29/34* (2013.01); *F04D 25/088* (2013.01); *Y10T 403/7005* (2015.01); *Y10T 403/7007* (2015.01)

(58) Field of Classification Search
CPC . F01D 5/30; F01D 5/3023; F01D 5/32; F04D 25/088; F04D 29/34; F04D 29/38; B64C 11/04; Y10T 403/7005; Y10T 403/7007
USPC ..... 416/210 R, 206, 207, 209, 214 R, 216, 416/220 R, 221, 220 A, 219 A
See application file for complete search history.

(56) References Cited

U.S. PATENT DOCUMENTS

| | | | | |
|---|---|---|---|---|
| 686,211 A | | 11/1901 | Dowson | |
| 1,479,895 A | * | 1/1924 | Colby | F01P 7/06 416/206 |
| 1,485,552 A | * | 3/1924 | Colby | F01P 7/06 416/206 |
| 2,618,201 A | * | 11/1952 | Brohl | G03B 3/02 285/210 |

(Continued)

FOREIGN PATENT DOCUMENTS

| | | |
|---|---|---|
| CN | 202048021 | 11/2011 |
| CN | 202560635 | 11/2012 |

(Continued)

*Primary Examiner* — Dwayne J White
*Assistant Examiner* — Sang K Kim
(74) *Attorney, Agent, or Firm* — Mark W Handley

(57) ABSTRACT

A T-shaped fan blade arm attachment is disclosed for securing ceiling fan blades to a rotor of a ceiling fan motor. The fan blade arms have T-shaped ends with an elastomeric ring disposed adjacent the T-shapes ends. A mounting bracket has mounting holes with opposed slots for receiving the T-shaped ends of the fan blade arms. The opposed slots are preferably aligned at an angle to the horizontal when mounted to a ceiling fan motor. The mounting bracket has a flat surface exteriorly disposed on the mounting bracket adjacent to respective ones of the mounting holes. The mounting bracket has two cams with lock grooves disposed on interior surfaces of the mounting bracket, adjacent to respective ones of the mounting holes. The T-shaped ends insert into the mounting holes and are rotated to guide the T-shaped ends of the fan blade arms into the lock grooves.

20 Claims, 6 Drawing Sheets

(56) References Cited

U.S. PATENT DOCUMENTS 3,026,943 A * 3/1962 Huber ..... F01P 5/02 416/206
3,174,553 A * 3/1965 Spears ..... F01P 7/06 416/206
3,597,111 A * 8/1971 Salisbury ..... F04D 29/321 415/201
3,731,515 A 5/1973 Master et al.
3,799,699 A * 3/1974 Master ..... F04D 29/36 416/206
3,986,780 A 10/1976 Nivet
5,072,341 A 12/1991 Huang
5,354,177 A 10/1994 Chang
5,545,011 A 8/1996 Molin et al.
5,873,701 A * 2/1999 Shiu ..... F04D 29/34 416/205
5,944,486 A 8/1999 Hodgkins, Jr.
6,039,540 A 3/2000 Wu
6,059,531 A 5/2000 Tai
6,062,820 A 5/2000 Wang
6,241,475 B1 * 6/2001 Blateri ..... F04D 25/088 416/206
6,261,064 B1 7/2001 Tang
6,347,924 B1 2/2002 Chang
6,508,629 B2 1/2003 Kerr, Jr.
6,595,754 B2 * 7/2003 Kuang ..... F04D 29/34 416/210 R
6,692,233 B2 2/2004 Liang
6,719,531 B2 4/2004 Wu
6,726,453 B1 4/2004 Hsieh
6,758,626 B1 7/2004 Tseng
6,863,499 B2 3/2005 Pearce
6,935,842 B2 8/2005 Tai
7,661,215 B2 * 2/2010 Okamoto ..... G09F 7/06 40/620
7,997,864 B2 8/2011 DeLeon
8,021,119 B2 9/2011 Wang
8,029,243 B2 10/2011 Wang
8,092,184 B2 1/2012 Wang
8,197,216 B2 6/2012 Wang
8,356,979 B2 1/2013 Haynes
9,057,273 B2 * 6/2015 Wang ..... B64C 39/024
2003/0185684 A1 10/2003 Zhong
2006/0024165 A1 2/2006 Gajewski
2009/0246028 A1 10/2009 Richardson
2010/0150722 A1 6/2010 Tseng
2011/0020135 A1 1/2011 Itou et al.
2011/0158812 A1 6/2011 Lu
2012/0195762 A1 * 8/2012 Bianchi ..... B64C 27/48 416/214 R

FOREIGN PATENT DOCUMENTS

KR 20110131466 12/2011
TW 200940836 10/2009
WO WO0107316 A1 2/2001
WO WO2005031121 A1 4/2005

* cited by examiner

T-SHAPED FAN BLADE ARM ATTACHMENT

CROSS-REFERENCE TO RELATED APPLICATION

The present application is a continuation-in-part of U.S. Provisional Patent Application Ser. No. 61/843,079, filed 5 Jul. 2013, entitled "T-shaped Fan Blade Arm Attachment," and invented by John F. Mares and Donald J. Ladanyi.

TECHNICAL FIELD OF THE INVENTION

The present invention relates in general to ceiling fans, and in particular mounting devices for securing fan blades to rotors of ceiling fan motors.

BACKGROUND OF THE INVENTION

Ceiling fans have fan blades mounted to rotors of ceiling motors. Typically mounting brackets are secured to one of the ceiling fan rotors. Fan blades are then secured to the mounting brackets by means of fan blade arms. Each arm usually has a flat outward end to which the ceiling fan blade is mounted, preferably with a quick connection assembly such as that shown in U.S. Pat. No. 7,223,078, entitled "Rotary Plate Fastener for Ceiling Fan Blades," and invented by John F. Mares et al. or U.S. Pat. No. 7,351,037, entitled "Y-Connect Fastener For Ceiling Fan Blades," and invented by John F. Mares et al. In other embodiments the ceiling fan blade my be secured to the flat outward end of the blade arm with threaded fasteners. The inward end of the fan blade arms are also usually secured to the mounting bracket with threaded fasteners. Some fan blade mounting configurations have quick connect arrangements for securing fan blade arms to motor mounting brackets, such as spring biased lock members.

SUMMARY OF THE INVENTION

A T-shaped fan blade arm attachment is disclosed for securing fan blades to a mounting bracket fixed to a rotor for a ceiling fan motor. The mounting bracket has mounting holes which each have opposed slots for receiving a plurality of T-shaped ends of a fan blade arm. The opposed slots are preferably aligned at an angle to the horizontal when mounted to a ceiling fan motor. The fan blade arms have T-shaped ends with a rubber washer, or other bias means, disposed adjacent the T-shaped ends to provide a spring bias means. The mounting bracket has flat surfaces exteriorly disposed on the mounting bracket adjacent to respective ones of the mounting holes. The mounting bracket has two cams with lock grooves disposed on interior surfaces of the mounting bracket, adjacent to respective ones of the mounting holes and disposed on opposite sides of the mounting holes. The T-shaped ends of the fan blade arms are inserted through the mounting holes, and once through, are rotated to guide the ends of the fan blade arms along surfaces of the cams and into lock grooves, which pulls the fan blade arms against respective flat surfaces on the exterior of the mounting bracket to squeeze the rubber washer to provide a bias means there-between. In a second embodiment, a lock spring provided by a leaf spring which both defines a portion of a lock groove and provides a bias means for securing the T-shaped ends of the fan blade arms into the lock grooves.

DESCRIPTION OF THE DRAWINGS

For a more complete understanding of the present invention and the advantages thereof, reference is now made to the following description taken in conjunction with the accompanying Drawings in which

FIG. 1 is a perspective view of a T-shaped fan blade arm attachment which includes a mounting bracket and a fan blade arm, showing the fan blade arm as it is inserted into a mounting hole of the mounting bracket;

FIG. 2 is a partial perspective view of an end of a T-shaped fan blade arm and a section of the mounting bracket, showing the T-shaped fan blade arm spaced apart from a section of the mounting bracket;

FIG. 3 is perspective view of the fan blade arm and the mounting bracket of FIG. 2, looking upward from beneath the mounting bracket and the fan blade arm;

FIG. 4 is an enlarged, perspective view of an interior portion of the mounting bracket showing two opposed cams with locking grooves for securing the end of the T-shaped fan blade arm to the mounting bracket;

FIG. 5 is longitudinal sectional view of the mounting bracket and the T-shaped end of the fan blade arm, showing the mounting hole having a tapered cross-section for mating with the tapered end of the T-shaped fan blade arm;

FIG. 6 is a perspective view of a bushing formed of elastomeric materials to provide an alternative bias member fitting between the T-shaped fan blade arm and the mounting bracket;

FIG. 7 is a longitudinal section view of the bushing which provides the alternative bias member for fitting between the T-shaped fan blade arm and the mounting bracket;

FIG. 8 is a partial perspective view of an end of a second T-shaped fan blade arm and a second mounting bracket, showing the second T-shaped fan blade arm spaced apart from the second mounting bracket;

FIG. 9 is perspective view of the second blade arm and the second mounting bracket of FIG. 8, looking upward from beneath the second mounting bracket and the second fan blade arm;

FIG. 10 is an enlarged, perspective view of an interior portion of the second mounting bracket showing two opposed cams with a locking groove and a lock spring for securing the end of the second T-shaped fan blade arm to the second mounting bracket;

FIG. 11 is a top view of the second blade arm having a T-shaped post with a first, elongated cross-member and a second cross-member of shorter length than the first cross-member;

FIG. 12 is an end view of the second blade arm;

FIG. 13 is a rear view of the second mounting bracket;

FIG. 14 is a top view of the second mounting bracket;

FIG. 15 is a front view of the second mounting bracket;

FIG. 16 is a sectional view of the second mounting bracket, taken along section line 16-16 of FIG. 13, and shows a vertical sectional view of the second mounting hole;

FIG. 17 is a sectional view of the second mounting bracket, taken along section line 17-17 of FIG. 13, and shows a horizontal sectional view of the second mounting hole;

FIG. 18 is a sectional view of the second mounting bracket, taken along section line 18-18 of FIG. 13, and shows a vertical section of one of the cam locks of the mounting bracket; and FIG. 19 is a sectional view of the second mounting bracket, taken along section line 19-19 of FIG. 14, and shows a vertical section view of a mounting hole and mounting foot for the second mounting bracket.

DETAILED DESCRIPTION OF THE INVENTION

Figure 1:
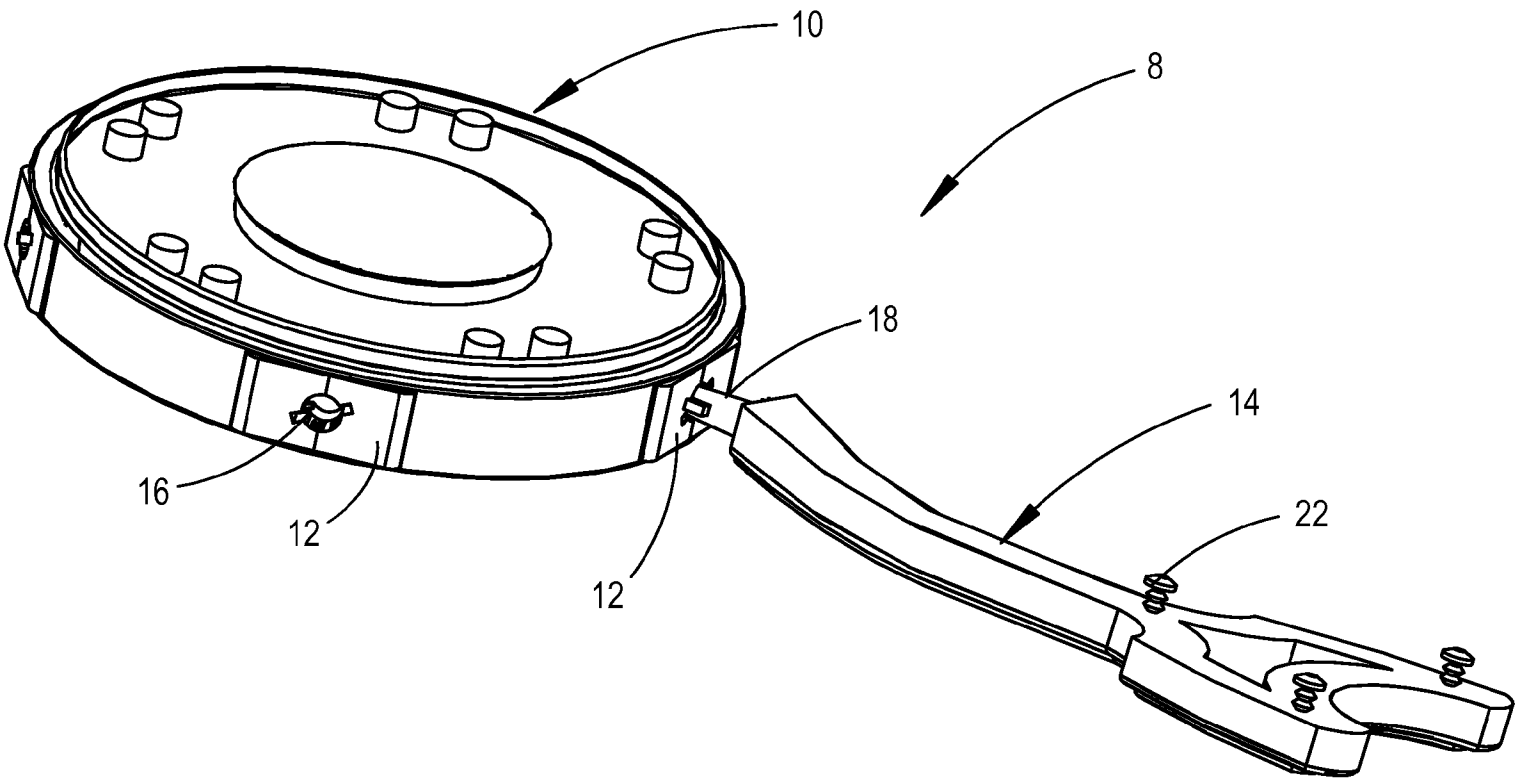
FIGS. 1 through 19 show various aspects for a T-shaped fan blade arm attachment made according to the present invention, as set forth below.

Referring to the Figures, FIG. 1 is a perspective view of a T-shaped fan blade arm attachment 8 for securing a ceiling fan blade to a rotor mounted disc 10 of a ceiling fan motor. The blade arm attachment 8 includes a mounting bracket 12 and a fan blade arm 14 for each fan blade. The mounting brackets 12 are secured in fixed relation to the rotor disc 10. The fan blade arm 14 is shown as it is being inserted into a mounting hole 16 of one of the mounting brackets 12. The T-shaped fan blade arm attachment 8 is provided for securing fan blades to the mounting bracket 12 without the use of hand tools. The mounting holes 16 in the mounting bracket 12 each have opposed slots 26 for receiving a plurality of T-shaped end posts 18 of the blade arms 14.

Figure 3:
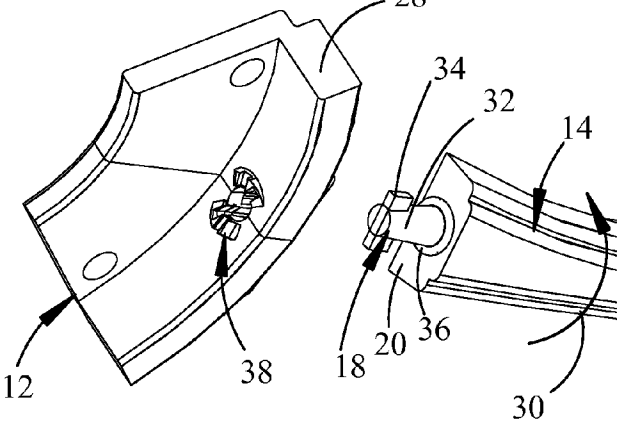
Figure 2:
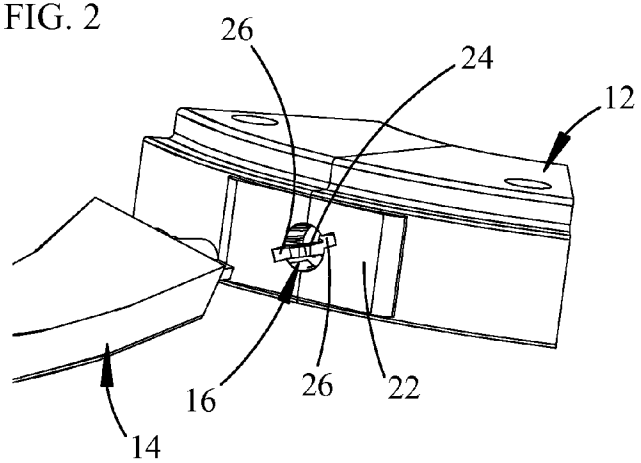

FIG. 2 is a partial perspective view of an end of a T-shaped fan blade arm 14 and a section of the mounting bracket 12, showing the T-shaped fan blade arm 14 spaced apart from the mounting bracket 12. The mounting bracket has a sidewall 28 through which the mounting hole 16 extends. The mounting hole 16 has a main bore 24 and two opposed slots 26. The opposed T-slots 26 are preferably aligned one hundred and eighty degrees apart in the plane of the flat surface 22, and at an angle to the horizontal when the mounting bracket 12 is mounted to a ceiling fan motor. The mounting bracket 12 has the flat surface 22 exteriorly disposed on the mounting bracket 12 adjacent to respective ones of the mounting holes 16. FIG. 3 is a perspective view of the end of the fan blade arm 14 and the mounting bracket 12, looking upward from beneath the mounting bracket 12 and the T-shaped fan blade arm 14 of FIG. 2. The blade arm 14 has a T-shaped end post 18 with a main body 32 and two lugs 34 which extend outward in opposite directions for opposite sides of the main body 32. A bias ring 36 disposed adjacent to the flat end surface 20 of the blade arm 14. The bias ring 36 is preferably provided by an elastomeric washer, such as a rubber washer, but other materials may be used to provide the bias ring 36, including lock washers made of metal or bevel washers. An O-ring formed of elastomeric materials may also be used to provide the bias ring 36. The bias ring 36 preferably is disposed around the T-shaped end post 18 to provide a spring bias means pulling the lugs 34 of the post 18 into the lock grooves 46 of the cam locks 38. The fan blade arm 14 is rotated in angular direction 30 after the T-shaped end post 18 is inserted through the mounting hole 16 to engage the lugs 34 against the cam locks 38 and non-rotatably secure the fan blade arm 14 to the mounting bracket 12.

Figure 4:
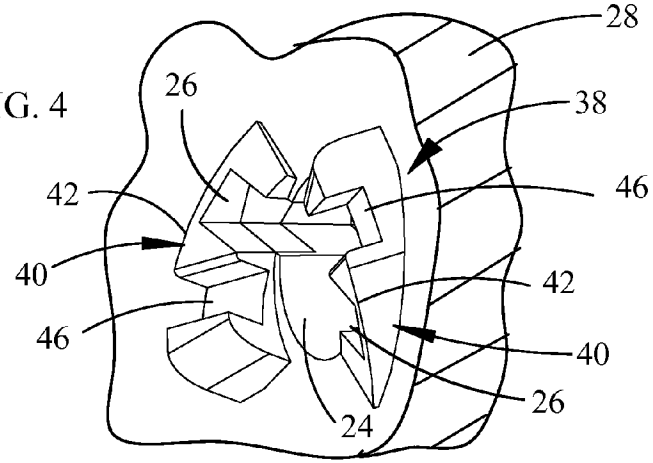

FIG. 4 is an enlarged, perspective view of an interior portion of the mounting bracket 12 showing the cam locks 38 having two opposed cams 40 and lock grooves 46. The two cams 40 each have one of the lock grooves 46 disposed on an interior surface of the mounting bracket 12, adjacent to the mounting hole 16 and disposed on opposite sides of the mounting hole 16. The cams 40 define sloped cam surfaces 42 for guiding the lugs 34 into the lock grooves 40. The lock grooves 40 receive the lugs 34 of the T-shaped posts 18 and non-rotatably secure the fan blade arms 14 in fixed relation to the mounting bracket 12, such that the posts 18 do not rotate relative to the mounting bracket 12 when the lugs 34 are disposed within the lock grooves 40. The T-shaped end post 18 of the fan blade arms 14 is inserted through the mounting hole 16, with the lugs 34 passing through the opposed through-slots 26. Once through, the end post 18 is rotated to guide the lugs 34 of the posts 18 into the lock grooves 46. The bias ring 36 is squeezed between the flats 20 and 22, which energizes the bias ring 36 to pull the lugs 34 of the end posts 18 into the lock grooves 46. This provides a self-locking features for the T-shaped fan blade arm attachment 12.

Figure 5:
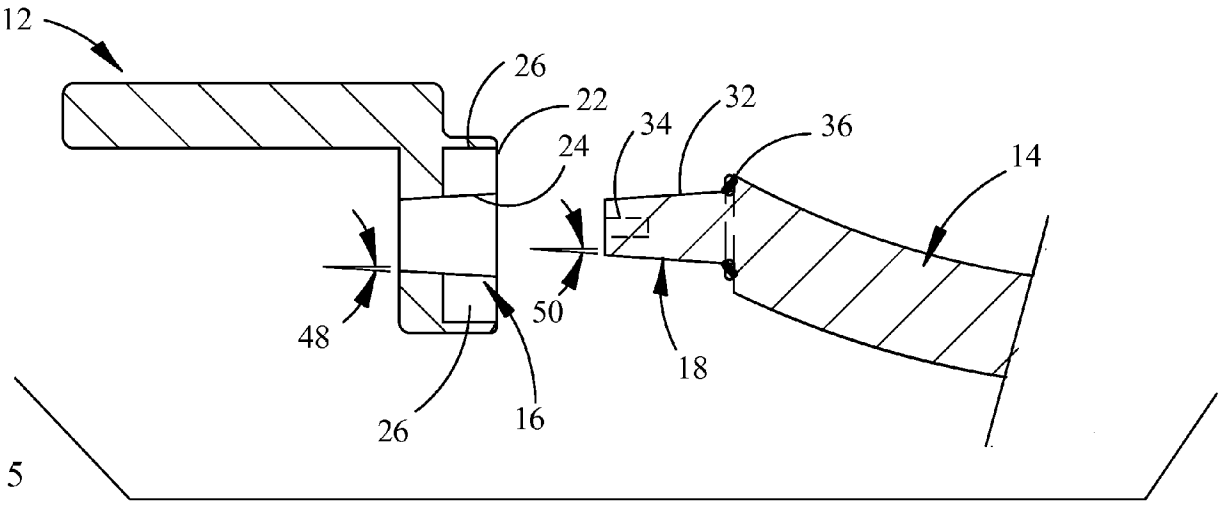

FIG. 5 is a vertical, longitudinal sectional view of an end section of the T-shaped fan blade arm 14 and the mounting bracket 12, showing a sectional view of the mounting hole 16 and the T-shaped end post 18. The main bore 24 of the mounting hole 16 is tapered to narrow as it extends inward into the body of the mounting bracket 12 from the flat surface 22 with a taper angle 48. Similarly, the main body 32 of the post 18 has a mating taper 50 for fitting into a locking engagement with the bore 24. In other embodiments the main body 32 and the bore 24 may have locking splines, or splines and grooves.

Figure 7:
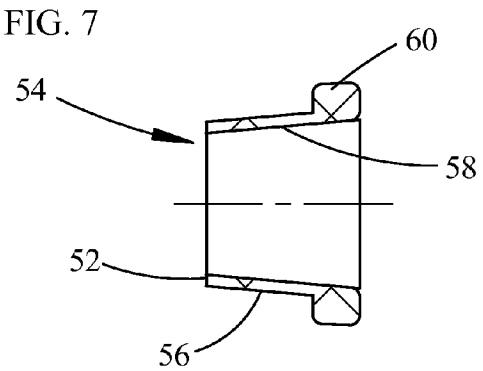
Figure 6:
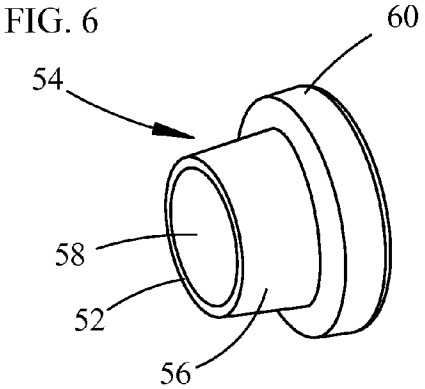

FIG. 6 is a perspective view and FIG. 7 is a longitudinal section view of a bushing 54 which is preferably formed of an elastomeric material. The bushing 54 provides an alternative bias member for fitting between the T-shaped end post 18 of the fan blade arm 14 and the mounting hole 16 of the mounting bracket 12, replacing the bias ring 36 of FIGS. 3 and 5. The bushing 54 is preferably formed of a silicone rubber, and has a hollow body 56 with a tapered exterior and a tapered bore 58. The tapered bore 58 is preferably sized and configured for fitting flush against the main body 32 of the T-shaped end post 18. The tapered exterior of the body 56 is sized and configured for fitting flush against the main bore 24 of the mounting hole 16 of the mounting bracket 12. An enlarged end of the body 56 is preferably formed with a cross-section similar to that of a flat washer, and defines a bias ring 60 which replaces the bias ring 36 of FIGS. 3 and 5. When the blade arm 14 is mounted to the mounting bracket 12, the bias ring 60 on one side fits flush against the flat surface 20 of the blade arm 14 and on the other side fits flush against the flat surface 22 of the mounting bracket 12, with the two surfaces 20 and 22 squeezing the bias ring 60 there-between with an interference fit. The interference fit provides a bias force to retain the T-shaped end post 18 locked into the mounting hole 16 of the mounting bracket 18. The terminal end 52 of the busing 54 will preferably fit flush against the side surfaces of the T-shaped lugs 34 which are closest and faced apart in opposed relation from the flat surface 20 of the fan blade arms 14.

Figure 9:
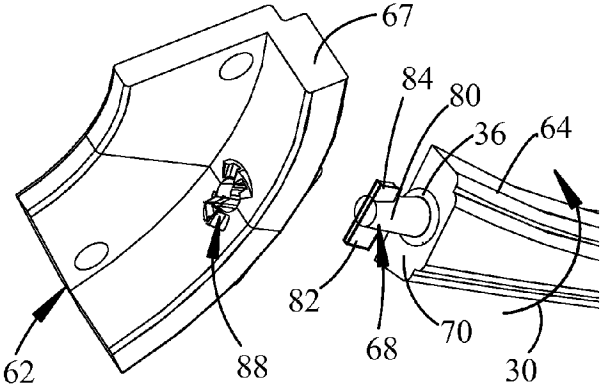
Figure 8:
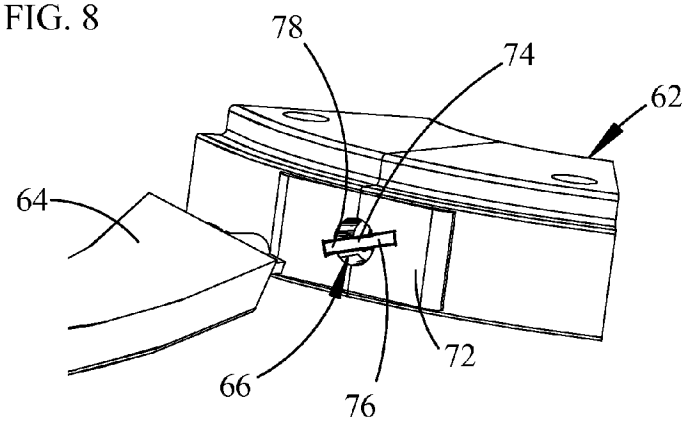

FIG. 8 is a partial perspective view of a second T-shaped fan blade arm 64 and a second mounting bracket 62, showing the second T-shaped fan blade arm 64 spaced apart from the second mounting bracket 62. FIG. 9 is perspective view of the second T-shaped fan blade arm 64 and the second mounting bracket 62 looking upward from beneath the second mounting bracket 62 and the second T-shaped fan blade arm 64 of FIG. 8. The second mounting bracket 62 has a mounting hole 66 which extends through a sidewall 67 of the mounting bracket 62 which is configured for receiving a T-shaped end post 68 of the second mounting bracket 62. The mounting hole 66 has a main bore 74 and two opposed slots 76 and 78. The opposed T-slots 76 and 78 are preferably aligned one hundred and eighty degrees apart in the plane of a flat 72, and at an angle to the horizontal when the mounting bracket 62 is mounted to a ceiling fan motor. The mounting bracket 62 has the flat surfaces 72 exteriorly disposed on the mounting bracket 62, adjacent to respective ones of the mounting holes 66. The second blade arm 64 has a T-shaped end post 68 which has a main body 80, and two cross-members which extend in opposite directions from opposite sides of the main bod to define lugs 82 and 84. The lug 82 is preferably longer than the lug 84. The mounting hole 66 has a centrally disposed bore 74 and the two slots 76 and 78 are disposed for registering with and receiving the main body 80, and the lugs 82 and 84 of the T-shaped end post 68. A bias ring 36 is disposed adjacent to a flat end surface 70 of the blade arm 64. As noted above, the bias ring 36 is preferably provided by an elastomeric washer, preferably formed of silicone rubber, but other materials may be used, including lock washers made of metal or bevel washers, an O-ring, or the busing 54 described herein-above. The bias ring 36 preferably is disposed around the T-shaped end post 68 to provide a spring bias means pulling the lugs 82 and 84 of the post 68 into the lock grooves 96 and 98 of the cam locks 88. The fan blade arm 64 is rotated in angular direction 30 after the T-shaped end post 68 is inserted through the mounting hole 66 to engage the lugs 82 and 84 against the cam locks 88 and non-rotatably secure the fan blade arm 64 to the mounting bracket 62.

Figure 10:
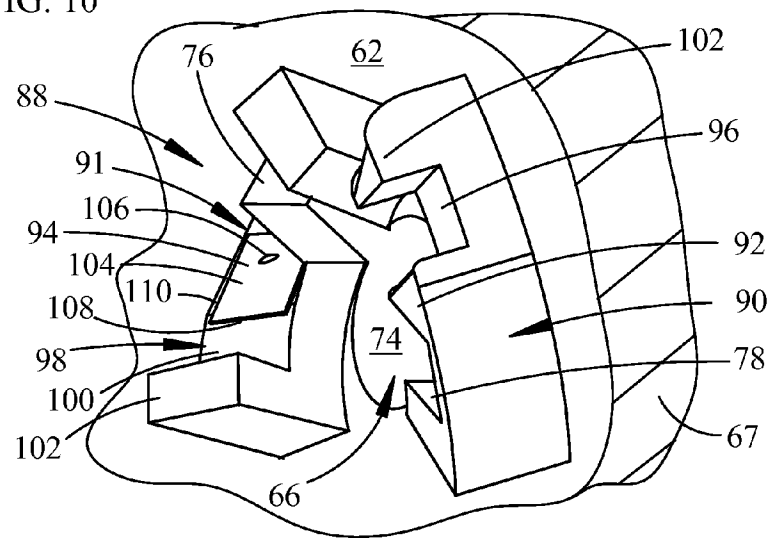

FIG. 10 is an enlarged, perspective view of an interior portion of the second mounting bracket 62 showing the two opposed cam locks 88 with a lock groove 96 and a lock groove 98. The lock groove 98 is preferably defined between a lock spring 110, shown as being provided by a leaf spring, and a stop 102 defined by a protuberance. The lock grooves 96 and 98 secure the end of the second T-shaped fan blade arm 64 to the second mounting bracket 62. The cam locks 88 have two cams 90 and 91 disposed on interior surfaces of the mounting bracket 12, adjacent to and disposed on opposite sides of the mounting hole 66. One of the cams 90 has a cam surface 92 extending between the through-slot 78 and the lock groove 96 for guiding the lug 84 from the slot 78 into the lock groove 96. The other of the of the cams 91 has a cam surface 94 defined by an outwardly disposed side of the lock spring 104 which extends between the through-slot 76 and the lock groove 98, for guiding the lug 82 from the slot 76 into the lock groove 98. The lock grooves 96 and 98 receive the lugs 82 and 84, respectively, of the T-shaped posts 68 for securing the fan blade arm 64 in fixed relation to the mounting bracket 62. The T-shaped end posts 68 of the fan blade arms 64 are inserted through the mounting holes 66, and once through, are rotated to guide the lugs 82 and 84 of the posts 68 into respective ones of the lock grooves 96 and 98. The bias ring 36 is squeezed between the flats 70 and 72, which energizes the bias ring 36 to pull the lugs 82 and 84 of the end post 68 into the lock grooves 96 and 98, respectively. This provides the self-locking feature for securing the blade arm 64 to the mounting bracket 62.

Figure 11:
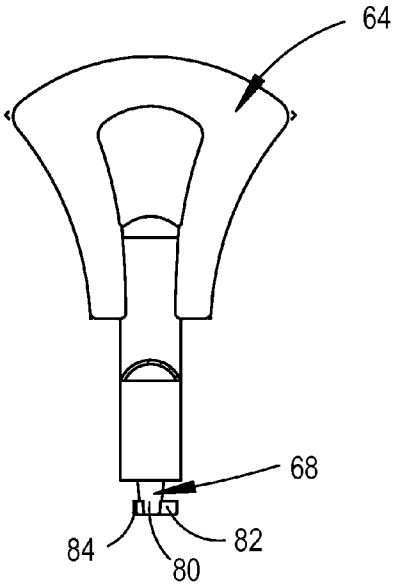
Figure 12:
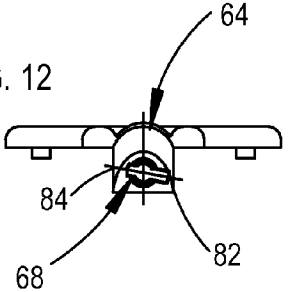

FIG. 11 is a top view and FIG. 12 is an end view of a second blade arm 64 having a T-shaped end mounting post 68. The mounting post 68 has a T-shaped outer terminal end defined by a first, longer cross-member defining a lug 82 and a second, shorter cross-member defining a lug 84 which both extend radially outward in opposite directions from the main body 80.

Figure 13:
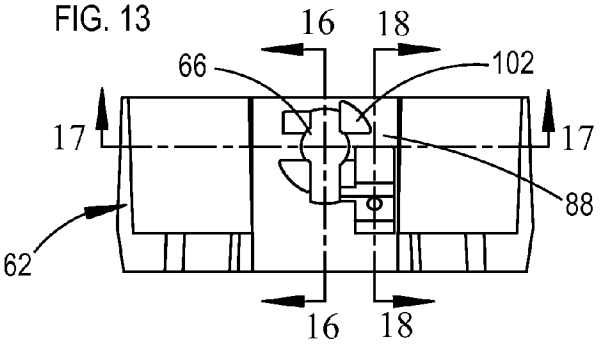
Figure 14:
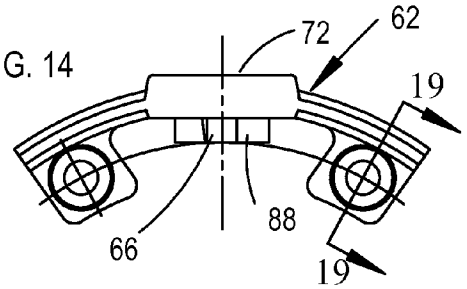
Figure 15:
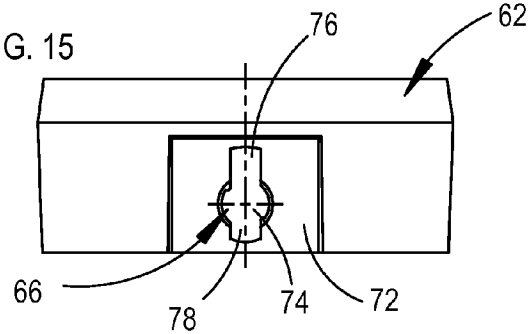

FIG. 13 is a rear view, FIG. 14 is a top view, and FIG. 15 is a front view of the second mounting bracket 62. The mounting hole 66 is shown extending through a side-wall of the mounting bracket 62, with the cam locks 88 disposed on opposite, inward sides of the mounting hole 66. The front view of FIG. 15 shows a terminal end of the mounting hole 66 having a centrally disposed hole 74, a longer T-slot 76 disposed on one side of the central hole 74 and a shorter T-slot 78 disposed on a second side of the central hole 74, with the two slots 76 and 78 being diametrically opposed, on opposite sides of central bore 74. The mounting hole 66 with the centrally disposed bore 74 and the two slots 76 and 78 are disposed for registering with and receiving the main body 80, and the lugs 82 and 84 of the T-shaped end post 68.

Figure 16:
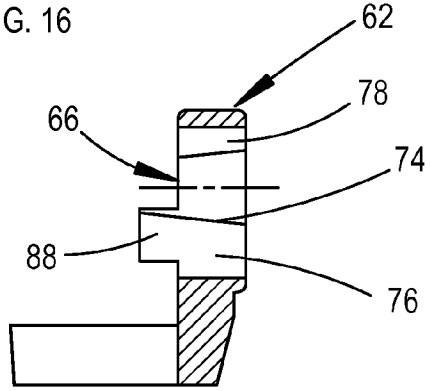
Figure 17:
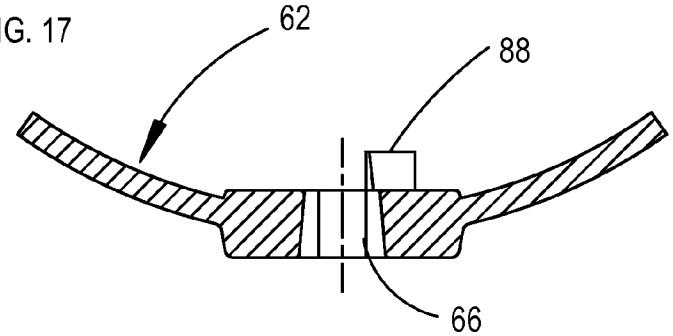

FIG. 16 is a sectional view of the second mounting bracket 62, taken along section line 16-16 of FIG. 13, and FIG. 17 is a sectional view of the second mounting bracket 62, taken along section line 17-17 of FIG. 13. The mounting hole 66 in the mounting bracket 62 is shown with the centrally disposed main bore 74, the longer elongate slot 76 and the shorter slot 78. The main bore 74 is tapered, reducing in diameter to a narrow cross-section in extending from an exterior to an interior of the mounting bracket 62. The taper of the main bore 74 is preferably configured for registering with and snugly receiving the tapered main body portion 80 of the T-shaped mounting post 68.

Figure 18:
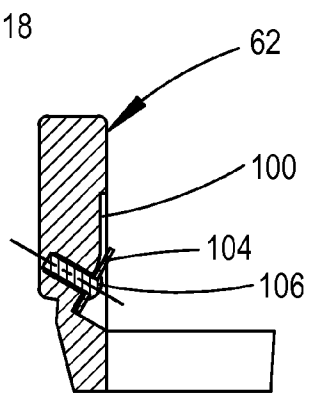

FIG. 18 is a sectional view of the second mounting bracket 62, taken along section line 18-18 of FIG. 13, and shows a vertical section of one of the cam locks 88 of the mounting bracket 62. The leaf spring providing the lock spring 104 is shown as a flat piece of spring steel which is fastened to the second mounting bracket 62 with a threaded fastener 106, spaced apart from and adjacent to the groove surface 100. Preferably the longitudinal length of the longer lug 82 of the T-shaped end post 68 will fit snugly between the terminal end of the lock spring 104 which defines the stop edge 108 and the stop 102 (shown in FIGS. 10 and 13). In this configuration the stop edge 108 of the lock spring 104 will press against the lug 82, providing a bias means for urging the T-shaped end post 68 further into the mounting hole 66. In some embodiments, the bias ring 36 may be omitted since the spring member 104 provides an alternative bias means to the bias ring 36 for urging the end post 68 into the mounting hole 66. In other embodiments both the bias ring 36 and the spring member 104 may be used to provide bias means for securing the fan blade arm 64 to the mounting bracket 62.

Figure 19:
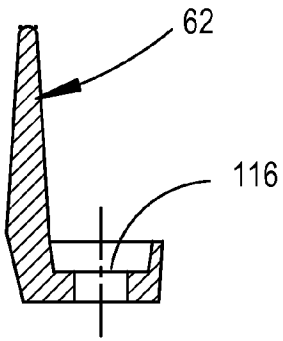

FIG. 19 is a sectional view of the second mounting bracket 62, taken along section line 19-19 of FIG. 14, and shows a vertical section view of a bracket mounting hole 116 located in a mounting foot for the second mounting bracket 62. The mounting hole 116 will receive a threaded fastener for securing the mounting bracket 62 in fixed relation to the rotor disc 10.

The present invention provides a quick, tool-less assembly with a self-locking feature for mounting fan blade arms to ceiling fans. A fan blade arm may be fixedly secured mounting bracket without tools, for securing a fan blade to a rotor disc of a ceiling fan motor for rotating therewith. Tool-less assembly improves ease of assembly and provides cost savings by decreasing the assembly time required for contractors to install ceiling fans, which includes attaching the ceiling fan blades to the ceiling fans.

Although the preferred embodiment has been described in detail, it should be understood that various changes, substitutions and alterations can be made therein without departing from the spirit and scope of the invention as defined by the appended claims.

What is claimed is:

1. An apparatus for securing a ceiling fan blade to a rotor of a ceiling fan motor, the apparatus comprising:

a fan blade arm having a T-shaped end post, said T-shaped end post having a main body and a lug, wherein said lug extends from a side of said main body of said T-shaped end post in first direction;

a mounting bracket having a mounting hole which has a main bore and a slot extending to one side of said mounting hole, wherein said main bore and said slot are configured for receiving said main bore receiving said main body and said slot receiving said lug for passing said main body and said lug through said mounting bracket, from an exterior side of said mounting bracket to an interior side of said mounting bracket;

a cam lock disposed on said interior side of said mounting bracket, adjacent said mounting hole, said cam lock having a cam surface disposed adjacent to said mounting hole and a lock groove surface disposed in spaced apart relation from said slot, separated from said slot by said cam surface;

said cam lock having a stop disposed adjacent to said lock groove surface, spaced apart from said cam surface by said lock groove surface;

said cam lock further including a lock spring mounted adjacent to said mounting hole, said lock spring extending between said slot and said lock groove surface and having a stop edge disposed in opposed relation to said stop, with said stop edge spaced apart from said stop above said lock groove surface;

wherein said cam surface and said lock groove surface of said cam lock are configured for engaging said lug of said T-shaped end post, with said cam surface guiding said lug onto said lock groove surface when said T-shaped end post is inserted through said mounting hole and rotated in a first angular direction relative to said mounting bracket; and wherein said lug of said T-shaped end post of said fan blade arm is inserted through said mounting hole, and once through, said T-shaped end post is rotated in said first angular direction to move said lug along said cam surface and onto said lock groove surface, and dispose said lug between said stop edge of said lock spring and said stop to non-rotatably secure said fan blade arm to said mounting bracket.

2. The apparatus set forth in claim 1, further comprising:

said T-shaped end post having a second lug extending from a side of said main body of said T-shaped end post in second direction;

said mounting hole of said mounting bracket having a second slot which extends to a second side of said mounting hole, wherein said main bore, said slot and said second slot are configured for said main bore receiving said main body, said slot receiving said lug, and said second slot for receiving said second lug and for passing said main body, said lug and said second lug through said mounting bracket, from an exterior side of said mounting bracket to an interior side of said mounting bracket.

3. The apparatus according to claim 2, wherein said second lug is shorter than said lug.

4. The apparatus according to claim 2, wherein said slot and said second slot of said mounting hole are aligned in opposed relation, extending from opposite sides of said mounting hole and at an angle to a horizontal direction when said mounting bracket is mounted to a rotor disc of a ceiling fan motor.

5. The apparatus according to claim 1, further comprising a bias means extending between said fan blade arm and said mounting bracket for urging said lugs of said T-shaped end post of said fan blade arm to push into said lock grooves.

6. The apparatus set forth in claim 5, wherein said bias means comprises an elastomeric ring extending between said fan blade arm and said mounting bracket.

7. The apparatus according to claim 6, further comprising:

an outward side of said mounting bracket disposed adjacent to said mounting hole having a first flat surface;

said fan blade arm having a second flat surface disposed adjacent to said T-shaped end post which is disposed in opposed relation to said first flat surface when said T-shaped end post is inserted into said mounting hole of said mounting bracket;

wherein said elastomeric ring is disposed around said T-shaped end post adjacent to said second flat surface, wherein said elastomeric ring engages between said first flat surface and said second flat surface, being squeezed there-between, when said T-shaped end post is inserted through said mounting hole.

8. The apparatus according to claim 5, wherein said lock spring defines said cam surface and said lock spring is configured for pushing said lug into said stop with said lug disposed above said lock groove surface.

9. The apparatus according to claim 8, wherein said lock spring is defined by a leaf spring.

10. An apparatus for securing a ceiling fan blade to a rotor of a ceiling fan motor, the apparatus comprising:

a fan blade arm having a T-shaped end post, said T-shaped end post having a main body and two lugs, wherein said two lugs extend from opposite sides of said main body of said T-shaped end post in opposite direction;

a mounting bracket having a mounting hole which has a main bore and two slots disposed in opposed relation on opposite sides of said mounting hole, wherein said main bore and said slots are configured for said main bore receiving said main body and said two slots receiving respective ones of said two lugs for passing said main body and said lugs through said mounting bracket, from an exterior side of said mounting bracket to an interior side of said mounting bracket;

two cam locks disposed on said interior side of said mounting bracket, adjacent said mounting hole, said two cam locks each having a cam surface disposed adjacent to said mounting hole and a lock groove surface disposed in spaced apart relation from respective ones of said slots, separated from said slots by a respective one of said cam surfaces;

said two cam locks each having a stop disposed adjacent to a respective one of said lock groove surfaces, spaced apart from a respective one of said cam surfaces by a respective one of said lock groove surfaces;

one of said cam locks further including a lock spring mounted adjacent to said mounting hole and extending between respective ones of said slots and said lock groove surfaces, said lock spring further including a stop edge disposed in opposed relation to an adjacent one of said stops, with said stop edge spaced apart from said adjacent one of said stops above one said lock groove surfaces;

wherein said cam surfaces and said lock groove surfaces of said two cam locks are configured for engaging respective ones of said lugs of said T-shaped end post, with said cam surfaces guiding said lugs onto a respective one of said lock groove surfaces when said T-shaped end post is inserted through said mounting hole rotated in a first direction relative to said mounting bracket; and wherein said T-shaped end of said fan blade arm is inserted through said mounting hole, and once through, is rotated in said first direction to move said lugs along respective ones of said cam surfaces and onto said lock grooves surfaces, and dispose one of said lugs between said stop edge of said lock spring and a respective one of said stops to non-rotatably secure said fan blade arm to said mounting bracket.

11. The apparatus according to claim 10, further comprising a bias means extending between said fan blade arm and said mounting bracket for urging said lugs of said T-shaped end post of said fan blade arm to push into said lock grooves.

12. The apparatus according to claim 11, wherein said bias means comprises an elastomeric ring extending between said fan blade arm and said mounting bracket.

13. The apparatus according to claim 12, further comprising:

an outward side of said mounting bracket disposed adjacent to said mounting hole having a first flat surface;

said fan blade arm having a second flat surface disposed adjacent to said T-shaped end post which is disposed in opposed relation to said first flat surface when said T-shaped end post is inserted into said mounting hole of said mounting bracket;

wherein said elastomeric ring is disposed around said T-shaped end post adjacent to said second flat surface, wherein said elastomeric ring engages between said first flat surface and said second flat surface, being squeezed there-between, when said T-shaped end post is inserted through said mounting hole.

14. The apparatus according to claim 11, wherein said a lock spring defines one of said cam surfaces, and said lock spring is configured for securing one of said lugs adjacent a respective one of said stops.

15. The apparatus according to claim 14, wherein said lock spring is defined by a leaf spring.

16. The apparatus according to claim 10, further comprising:

a first one of said lugs is longer than a second one of said lugs of said T-shaped end post; and said two slots of said mounting hole aligned in said opposed relation at an angle to a horizontal direction when mounted to a rotor disc of a ceiling fan motor.

17. An apparatus for securing a ceiling fan blade to a rotor of a ceiling fan motor, the apparatus comprising:

a fan blade arm having a T-shaped end post, said T-shaped end post having a main body and two lugs, wherein said two lugs extend from opposite sides of said main body of said T-shaped end post in opposite direction;

a mounting bracket having a mounting hole which has a main bore and two slots disposed in opposed relation on opposite sides of said mounting hole, wherein said main bore and said slots are configured for said main bore receiving said main body and said two slots receiving respective ones of said two lugs for passing said main body and said lugs through said mounting bracket, from an exterior side of said mounting bracket to an interior side of said mounting bracket;

two cam locks disposed on said interior side of said mounting bracket, adjacent said mounting hole, said two cam locks each having a cam surface adjacent to said mounting hole and a lock groove disposed in spaced apart relation from said mounting hole, separated from said mounting hole by a respective one of said cam surfaces;

wherein said cam surfaces and said lock grooves of said two cam locks are configured for engaging respective ones of said lugs of said T-shaped end post, with said cam surfaces guiding said lugs in a respective one of said lock grooves when said T-shaped end post is inserted through said mounting hole rotated in a first direction relative to said mounting bracket;

wherein the T-shaped ends of said fan blade arm are inserted through said mounting hole, and once through, are rotated in said first direction to move said lugs along respective ones of said cam surfaces and into said lock grooves to non-rotatably secure said fan blade arm to said mounting bracket; and a lock spring mounted to said mounting bracket, adjacent to said mounting hole, and extending between one of said two slots and a respective one of said lock grooves, said lock spring configured for securing one of said lugs in a respective one of said lock grooves.

18. The apparatus according to claim 17, further comprising:

an outward side of said mounting bracket disposed adjacent to said mounting hole having a first flat surface;

said fan blade arm having a second flat surface disposed adjacent to said T-shaped end post which is disposed in opposed relation to said first flat surface when said T-shaped end post is inserted into said mounting hole of said mounting bracket;

an elastomeric ring disposed around said T-shaped end post adjacent to said second flat surface, wherein said elastomeric ring engages between said first flat surface and said second flat surface, being squeezed there-between, when said T-shaped end post is inserted through said mounting hole.

19. The apparatus according to claim 17, wherein said lock spring extends between a respective one of said slots and one of said lock grooves to define one of said cam surfaces.

20. The apparatus according to claim 19, wherein said lock spring is defined by a leaf spring.

* * * * *